US006594372B2

(12) United States Patent
Nakaso

(10) Patent No.: US 6,594,372 B2
(45) Date of Patent: Jul. 15, 2003

(54) ELECTROACOUSTIC TRANSDUCER

(75) Inventor: Jiro Nakaso, Sagamihara (JP)

(73) Assignee: Victor Company of Japan, Ltd., Yokohama (JP)

( * ) Notice: Subject to any disclaimer, the term of this patent is extended or adjusted under 35 U.S.C. 154(b) by 0 days.

(21) Appl. No.: 10/193,280

(22) Filed: Jul. 12, 2002

(65) Prior Publication Data

US 2003/0021435 A1 Jan. 30, 2003

(30) Foreign Application Priority Data

Jul. 30, 2001 (JP) ..... 2001-229418

(51) Int. Cl.[7] ..... H04R 25/00

(52) U.S. Cl. ..... 381/396; 381/409; 381/423; 381/431

(58) Field of Search ..... 381/396, 398, 381/400, 403, 407, 409, 410, 412, 423, 424, 431

(56) References Cited

U.S. PATENT DOCUMENTS 5,664,024 A * 9/1997 Furuta et al. ..... 381/396

6,341,167 B1 * 1/2002 Okuyama et al. ..... 381/407

* cited by examiner

*Primary Examiner*—Huyen Le
(74) *Attorney, Agent, or Firm*—Jacobson Holman PLLC

(57) ABSTRACT

An electroacoustic transducer has a diaphragm having an asymmetric shape, having a flat vibrating surface with major and minor axes when viewed from a direction of vibration, having continuous curvatures of concavity and convexity in a direction of the major axis. The diaphragm is provided with a slot formed almost at the center of the vibrating surface in a direction perpendicular to the major-axis direction and a groove provided along the periphery of the vibrating surface. A fringe is connected to the groove as surrounding the groove, for sustaining the diaphragm against vibration. A voice-coil bobbin is connected to the diaphragm. A voice coil is wound around the voice-coil bobbin. Hook suspensions are provided at both ends of the voice coil in the major-axis direction to support the voice coil against vibration occurring when a magnetic circuit applies fluxes to the voice coil. Each hook suspension has an end portion fixed at one of the ends of the voice coil and another end portion fixed on a frame that sustains the fringe and the magnetic circuit.

2 Claims, 8 Drawing Sheets

ELECTROACOUSTIC TRANSDUCER

BACKGROUND OF THE INVENTION

The present invention relates to an electroacoustic transducer such as a slender speaker having high sound quality.

With increased popularization of high-vision and wide-vision etc., TV sets with wide screens have widely been used. There are, however, increased demands of thin and not-so-wide TV sets and also audio component systems.

Speaker units for TV sets are for example one of the causes for TV sets that inevitably become wide. Because speaker units are mostly set on both sides of a cathode ray tube. Thus, most known speaker units have been not so wide such as rectangular and oval types. As cathode ray tubes become wide, however, there are strong demands of slender speaker units as narrow as possible and high sound quality in accordance with enhanced high picture quality.

SUMMARY OF THE INVENTION

A purpose of the present invention is to provide an electroacoustic transducer that exhibits a flat frequency response and emits sound waves with less harmonic distortions over the range from low to high frequencies.

The present invention provides an electroacoustic transducer including: a diaphragm having an asymmetric shape, having a flat vibrating surface with major and minor axes when viewed from a direction of vibration, having continuous curvatures of concavity and convexity in a direction of the major axis, provided with a slot formed almost at the center of the vibrating surface in a direction perpendicular to the major-axis direction and a groove provided along the periphery of the vibrating surface; a fringe connected to the groove as surrounding the groove, the fringe sustaining the diaphragm against vibration; a voice-coil bobbin connected to the diaphragm; a voice coil wound around the voice-coil bobbin; a magnetic circuit for applying fluxes to the voice coil for vibration; a frame for sustaining the fringe and the magnetic circuit; and hook suspensions provided at both ends of the voice coil in the major-axis direction to support the voice coil, each hook suspension having an end portion fixed at one of the ends of the voice coil and another end portion fixed on the frame.

DETAILED DESCRIPTION OF PREFERRED EMBODIMENTS

Preferred embodiments according to the present invention will be disclosed with reference to the attached drawings. The following embodiments disclosed later in detail are some of preferred examples with several technically preferable requirements according to the present invention. Various changes and modification may, however, be made unless there are no specific requirements that limit the present invention.

Basic Configuration

Figure 1:
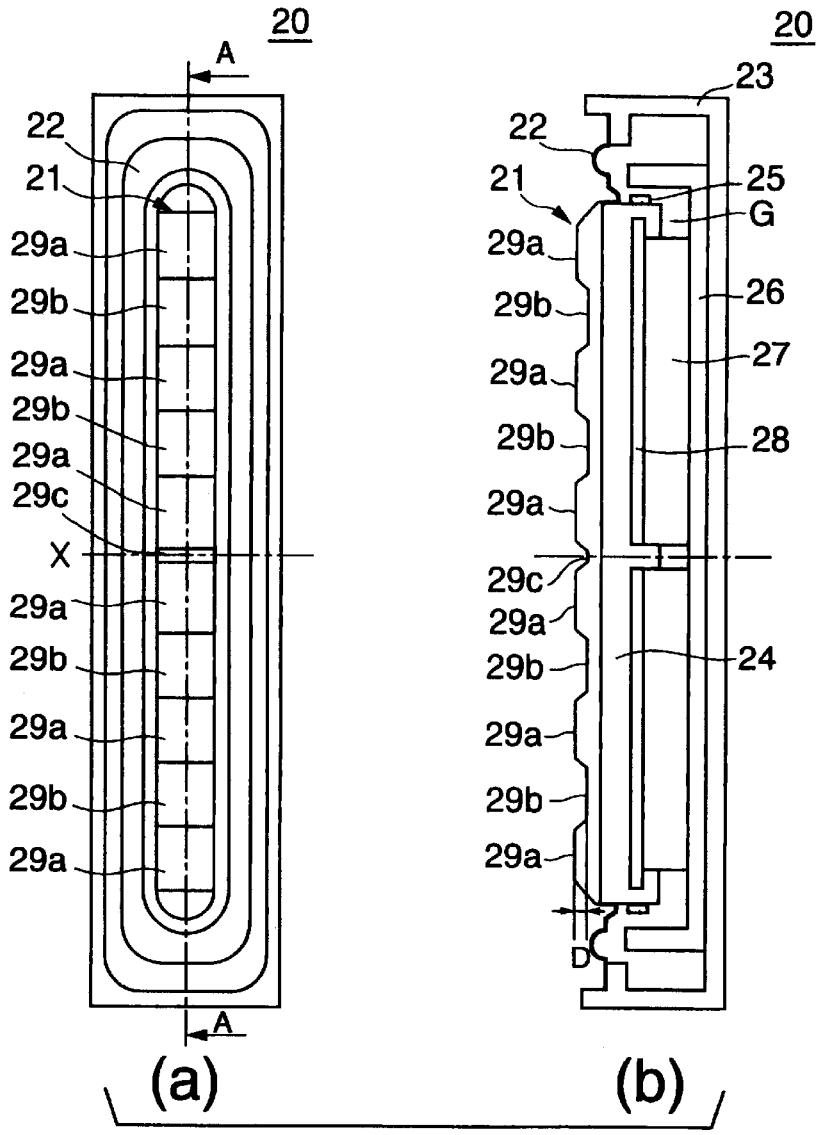
FIG. 1 shows a plan view (a) and a sectional view (b) taken on line A—A in the plan view (a), for an electroacoustic transducer having a basic configuration in the present invention.
Figure 2:
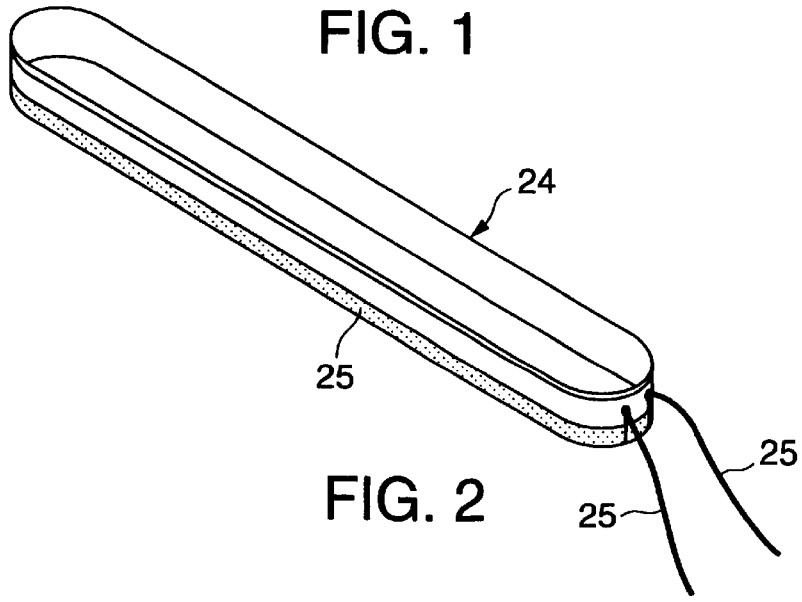
FIG. 2 shows a voice coil bobbin used for the electroacoustic transducer shown in FIG. 1.
Figure 3:
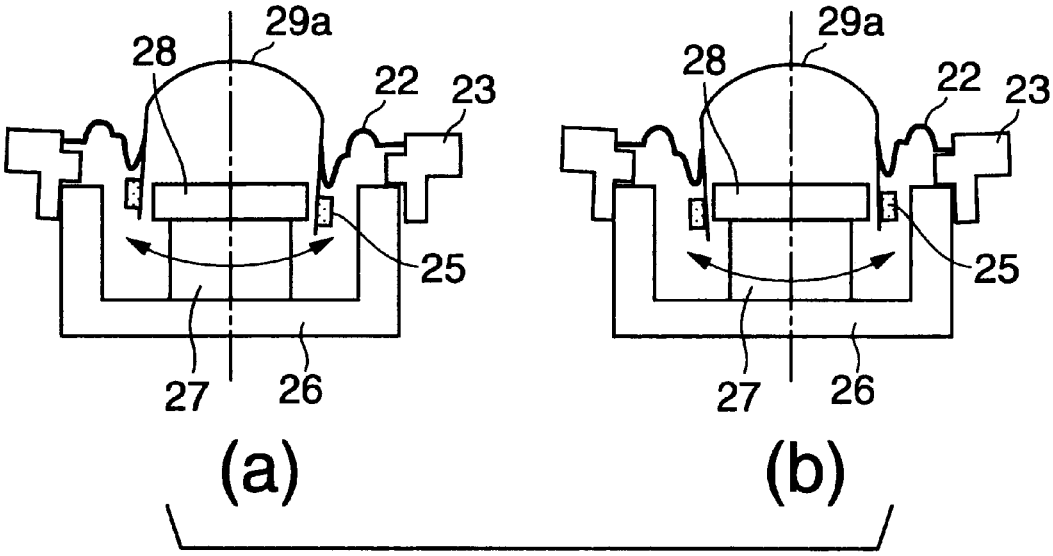
FIG. 3 illustrates occurrence of lateral vibration in a low-frequency range in a minor-axis direction of the electroacoustic transducer shown in FIG. 1.

A basic configuration of an electroacoustic transducer according to the present invention will be disclosed with reference to FIGS. 1 to 3.

Shown in FIG. 1 are a plan view (a) and a sectional view (b) taken on line A—A in the plan view (a), for a slender electroacoustic transducer 20 having the basic configuration according to the present invention.

The electroacoustic transducer 20 has a asymmetric diaphragm 21 which is flat when viewed from the direction of vibration, with major and minor axes, having continuous curvatures of concavity and convexity in the direction of sound emission. A fringe 22 is joined to the diaphragm 21 at the periphery of the diaphragm and held by a frame 23.

A track-type voice-coil bobbin 24 shown in FIG. 2 is attached to the diaphragm 21 at the outer lower edge of the diaphragm, with a voice coil 25 wound around the bobbin. The voice-coil bobbin 24 is hanging in a magnetic gap G of a magnetic circuit which will be described later, for generating a driving power from voice signal currents and fluxes.

The frame 23 is formed like a box, a part of each side face of the frame being protruding toward the fringe 22. The magnetic circuit is installed in the frame 23. The magnetic circuit includes, for example, an iron yoke 26, a magnet 27 made of neodymium and an iron pole piece 28, fixed at respective positions by a tool (not shown). In particular, the magnet 27 and the pole piece 28 are fixed at the positions that correspond to a main vibrating section of the diaphragm 21.

The diaphragm 21 is described in detail. It has an asymmetric shape which is flat when viewed from the direction of vibration, with major and minor axes, having continuous curvatures of concavity and convexity in the direction of sound emission, as mentioned above, with portions 29*a* formed in convexity whereas portions 29*b* in concavity. The convex portions 29*a* and the concave portions 29*b* are provided alternately to form the continuous curvatures. The concave portions 29*b* have almost the same depth D. The diaphragm 21 is made of a polyimide (PI) film that is heat-resistant against the voice coil 25 and excellent in mechanical properties. The diaphragm 21 is provided with a concave slot 299*c* formed almost at the center section.

The diaphragm 21 is thin and light. And, hence it could touch the components of the magnetic circuit due to lateral vibration of the vibrating sections, such as the voice coil 25 wound around the voice-coil bobbin 24, in the minor-axis direction, particularly, in a low frequency range, as indicated by allows in FIG. 3, when driven by a powerful magnetic circuit.

Figure 4:
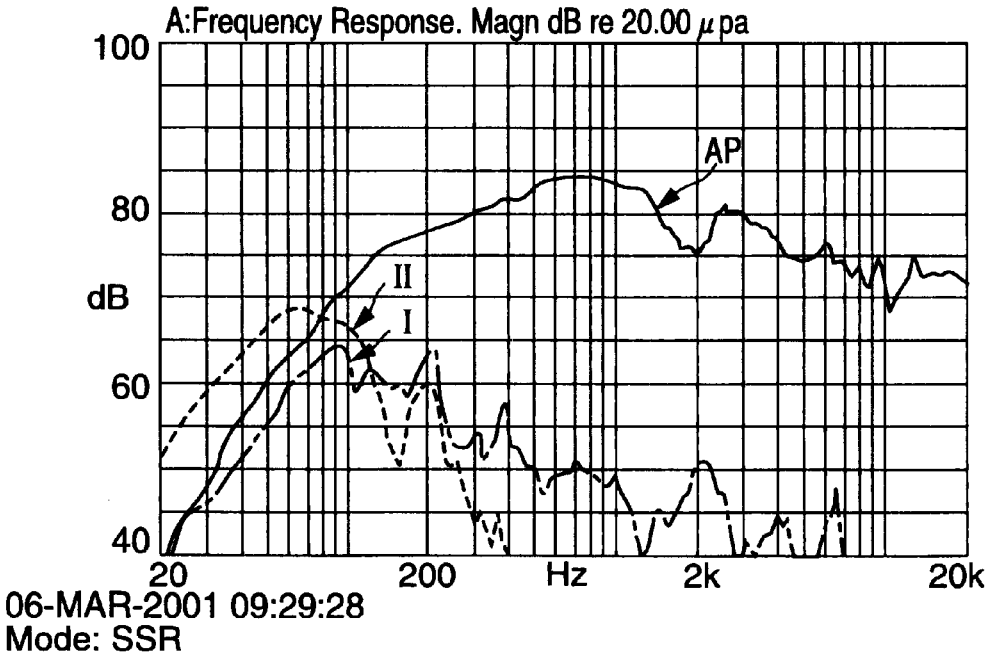
FIG. 4 shows a graph indicating the frequency characteristics of the electroacoustic transducer shown in FIG. 1.

Such mechanical contact could generate abnormal sounds or increase high-order harmonic waves such as the secondary harmonic distortion I and the tertiary harmonic distortion II shown in FIG. 4. The acoustic-pressure frequency characteristics AP for the electroacoustic transducer 20 is also shown in FIG. 4.

Figure 5:
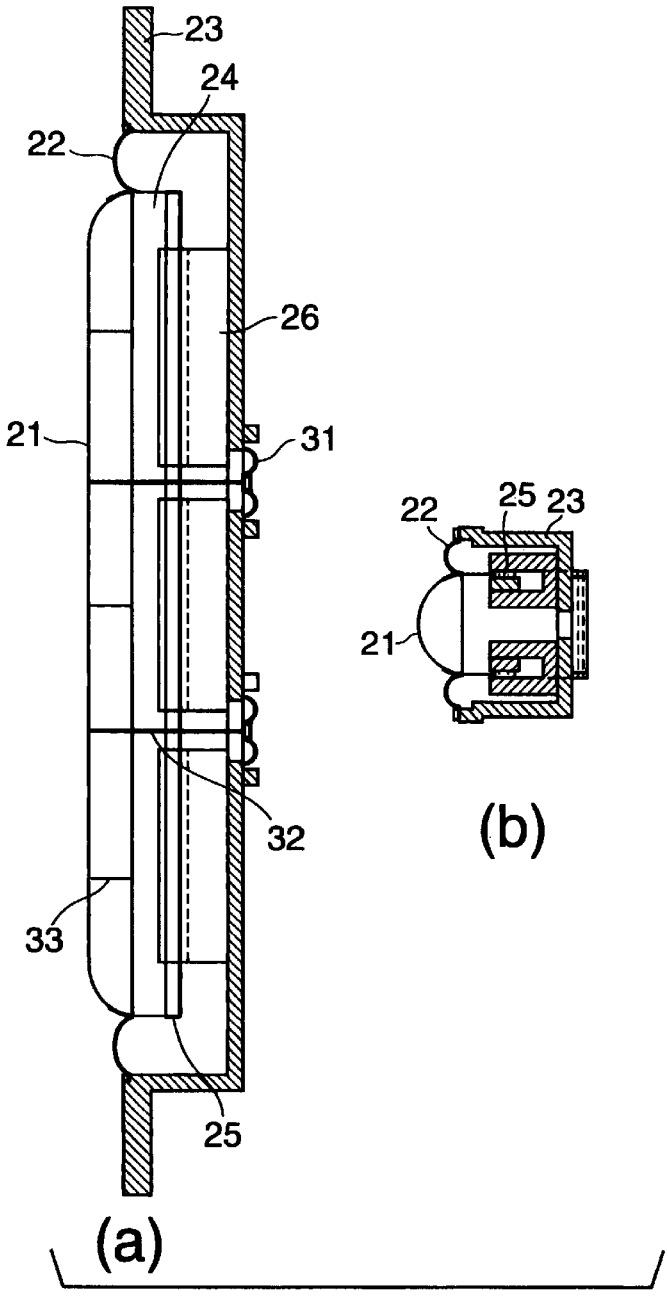
FIG. 5 shows a sectional view (a) and a side view (b) for a modification to the voice-coil bobbin of the electroacoustic transducer shown in FIG. 1.

The problems can be solved by providing the voice-coil bobbin 24 with several damper-supporting beams 32 to partition the magnetic circuit into several sections, with dampers 31 at the back of the magnetic-circuit sections, as shown in FIG. 5.

Figure 6:
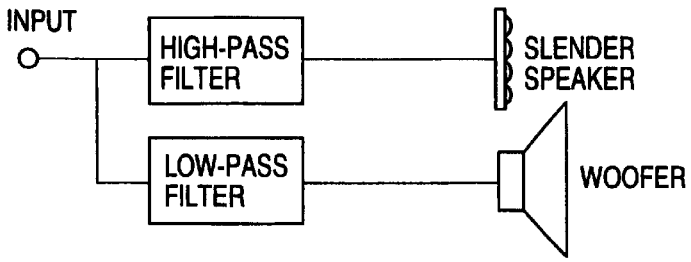
FIG. 6 shows a 2-way speaker system using the electroacoustic transducer shown in FIG. 1 and a woofer.

Or, such problems can be solved by means of a multi-way speaker system such as a 2-way speaker system shown in FIG. 6 in which a woofer is provided in addition to a slender speaker with high- and low-pass filters for preventing the slender speaker from low-frequency inputs that could cause abnormal sounds.

The former arrangement solves the problems, however, require partition of the magnetic circuit in accordance with the number of the dampers 31, as shown in FIG. 5. This solution therefore causes low magnetic flux density and complex configuration with a number of components, thus requiring further improvements in performance and cost. The latter solution also causes complex configuration.

Embodiments

Disclosed below are embodiments developed from the basic configuration described above.

Figure 7:
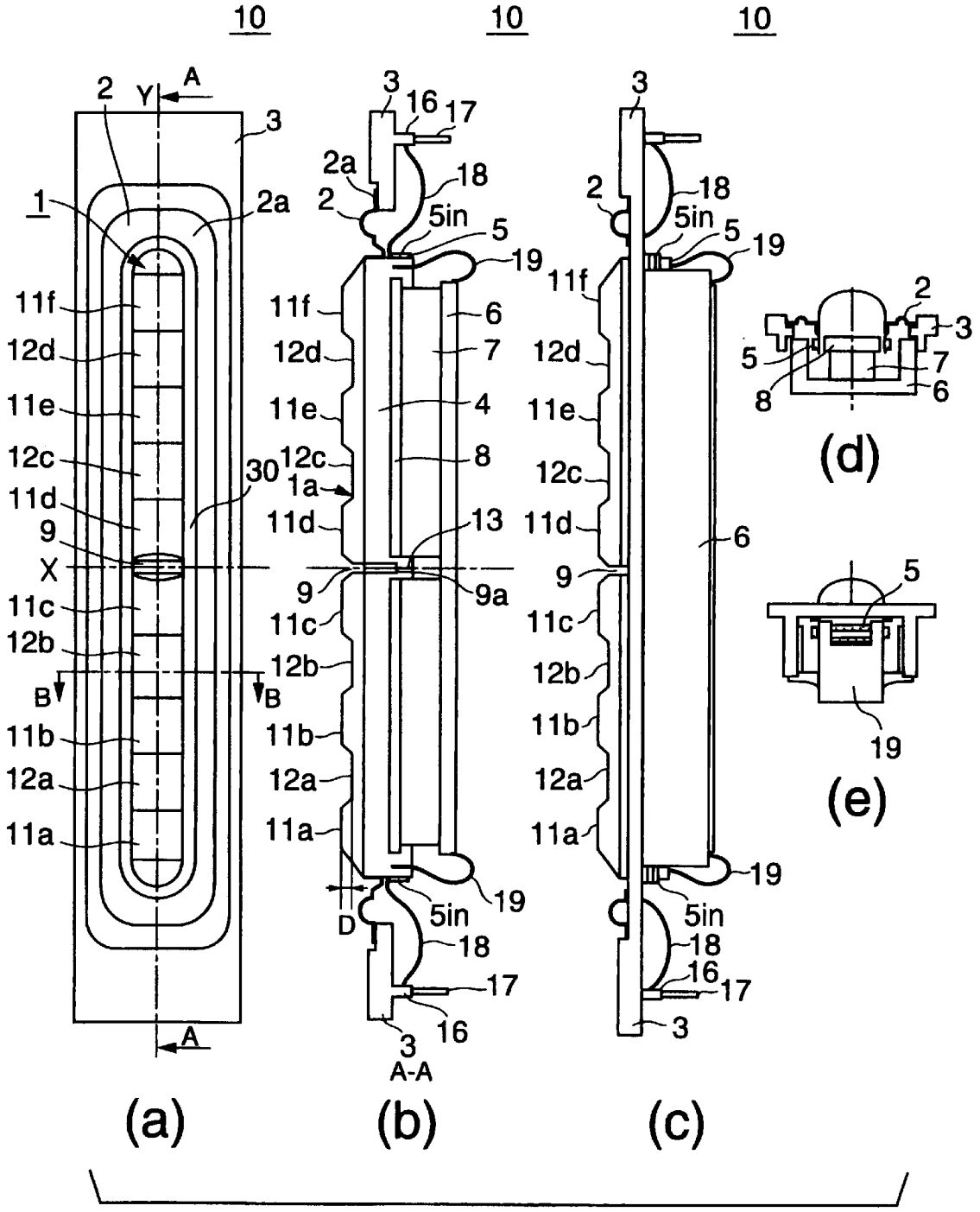
FIG. 7 shows an electroacoustic transducer as a preferred embodiment according to the present invention, with a plan view (a), a sectional view (b) taken on line A—A in the plan view (a), a side view (c) looked from direction X in the plan view (a), a sectional view (d) taken on line B—B in the plan view (a), and a side view (e) looked from direction Y in the plan view (a)

Shown in FIG. 7 is an electroacoustic transducer 10 as a preferred embodiment according to the present invention, with a plan view (a), a sectional view (b) taken on line A—A in the plan view (a), a side view (c) looked from direction X in the plan view (a), a sectional view (d) taken on line B—B in the plan view (a), and a side view (e) looked from direction Y in the plan view (a).

The electroacoustic transducer 10 has a asymmetric diaphragm 1 which is flat when viewed from the direction of vibration, with major and minor axes, having continuous curvatures of concavity and convexity in the direction of sound emission. The diaphragm 1 has a slot 9 formed almost at the center in the direction perpendicular to the longitudinal direction of the diaphragm, and also a long groove 30 provided along the outer periphery of the diaphragm. A fringe 2 is joined to the groove 30 as surrounding the groove and held by a frame 3.

Figure 8:
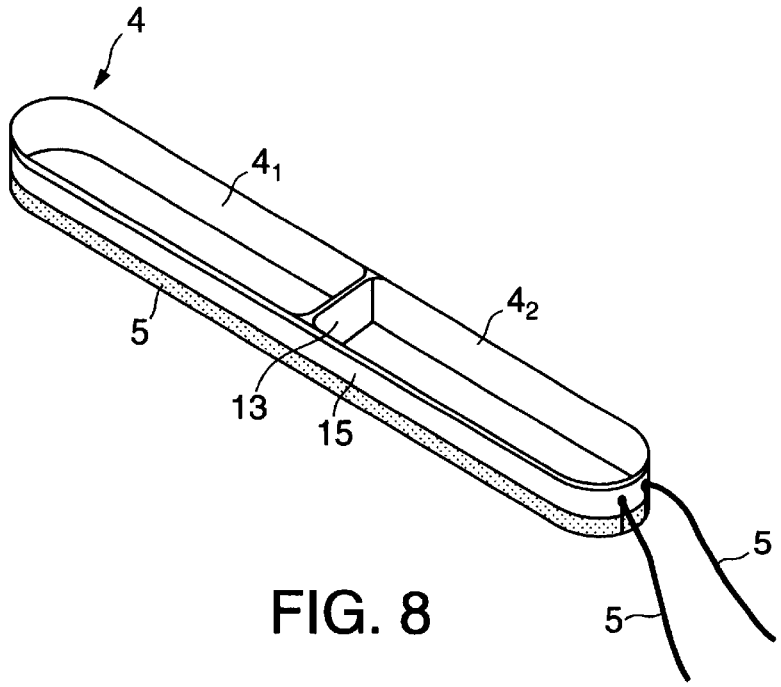
FIG. 8 shows a perspective view of a voice-coil bobbin with a voice coil wound therearound for the electroacoustic transducer shown in FIG. 7.

A track-type voice-coil bobbin 4 shown in FIG. 8 is attached to the diaphragm 1 at the outer lower edge of the diaphragm, with a voice coil 5 wound around the bobbin. The voice-coil bobbin 4 is hanging in a magnetic gap G of a magnetic circuit for generating a driving power from voice signal currents and fluxes.

The magnetic circuit is installed in the frame 3. The magnetic circuit includes, for example, an iron yoke 6, a magnet 7 made of neodymium and an iron pole piece 8, fixed at respective positions by a tool (not shown). In particular, the magnet 7 and the pole piece 8 are fixed at the positions that correspond to a main vibrating section of the diaphragm 1.

In the sectional view (b) and the side view (c), the electroacoustic transducer 10 has protrusions 16 on the frame 3 at the upper and lower frame sections. Mounted on each protrusion 16 is a connection terminal 17 (the lower portion of which is embedded into the protrusion 16) connected to a terminal 5in of the voice coil, for electrical input, via a lead wire 18 an end of which is connected to the embedded connection-terminal portion. The protrusions 16 and the connection terminal 17 are not shown in the side view (e) for brevity.

The diaphragm 1 is described in detail. As mentioned above, it has an asymmetric shape which is flat when viewed from the direction of vibration, with major and minor axes, having continuous curvatures of concavity and convexity in the direction of sound emission, with the slot 9 formed almost at the center in the direction perpendicular to the longitudinal direction of the diaphragm, and the long groove 30 provided along the periphery of the diaphragm.

Portions 11*a*, 11*b*, 11*c*, 11*d*, 11*e* and 11*f* are formed in convexity whereas portions 12*a*, 12*b*, 12*c* and 12*d* in concavity. These convex and the concave portions are provided alternately to form the continuous curvatures. The concave portions have almost the same depth D except the slot 9 located at the center of the diaphragm 1. The diaphragm 1 is made of a polyimide (PI) film that is heat-resistant against the voice coil 5 and excellent in mechanical properties.

Figure 9:
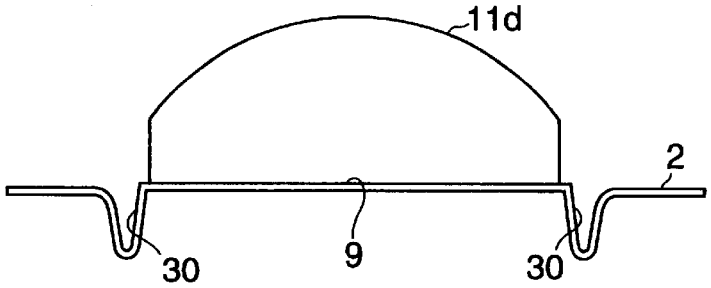
FIG. 9 shows a transverse cross section, in the longitudinal direction, of the diaphragm of the electroacoustic transducer shown in FIG. 7.
Figure 10:
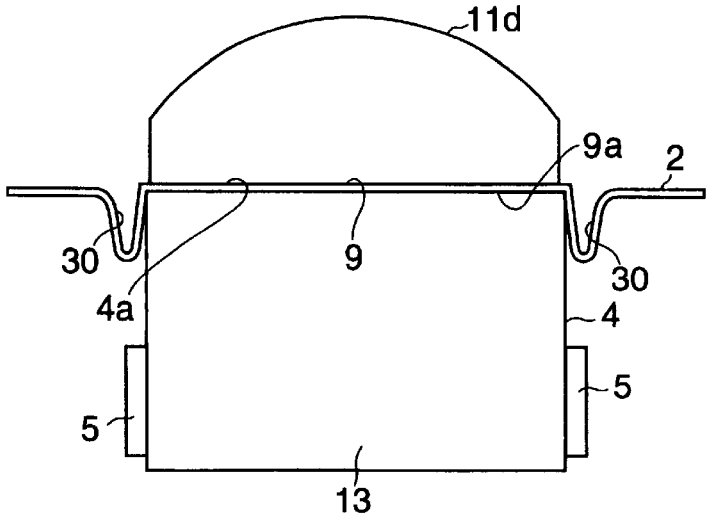
FIG. 10 shows another transverse cross section, in the longitudinal direction, of the diaphragm of the electroacoustic transducer shown in FIG. 7, with the voice-coil bobbin attached to the diaphragm.

As illustrated in FIGS. 9 and 10, the long groove 30, provided along the periphery of the diaphragm 1, is shallow so as not to reach the voice coil 5 wound around the voice-coil bobbin 4, with a width like the magnetic gap. One of the dimensional requirements for the groove 30 is that it does not touch the magnetic circuit when the vibrating section vibrates. Several other requirements such as surface accuracy for the groove 30 depends on a mold.

Disclosed next in detail with reference FIGS. 8 to 10 is the voice-coil bobbin 4 fixed on the outer lower edges of the diaphragm 1.

As shown in FIG. 8, the voice-coil bobbin 4 has an asymmetric shape which is flat with major and minor axes when viewed from the direction of vibration for the diaphragm 1, having portions formed in straight and parallel to each other in the direction in relation to the major axis of the diaphragm 1.

Moreover, the voice-coil bobbin 4 has a voice-coil forming portion, around which the voice coil 5 is wound, split into two sections $4_1$ and $4_2$ in the direction of the major axis of the diaphragm 1. The split portions are joined so that they are parallel to each other in the direction of the minor axis of the diaphragm 1, to form a reinforcing beam 13. A band 15 made of a kraft paper is wound around the bobbin 4 as a reinforcing paper.

The voice-coil bobbin 4 is made smaller than the inner width of the groove 30, as shown in FIG. 10. The groove 30 is shallow so as not to reach the voice coil 5 wound around the voice-coil bobbin 4. These are the assembly requirements for the voice-coil bobbin 4 to be fixed at a regular position when it is inserted from the lower side until its upper part 4*a* touches the lower part 9*a* of the groove 9, as illustrated in the sectional view (b) in FIG. 7 and also FIG. 10. The gaps between the groove 30 and voice-coil bobbin 4 are filled with an adhesive (not shown) so that they can be fixed at the regular position.

Figure 11:
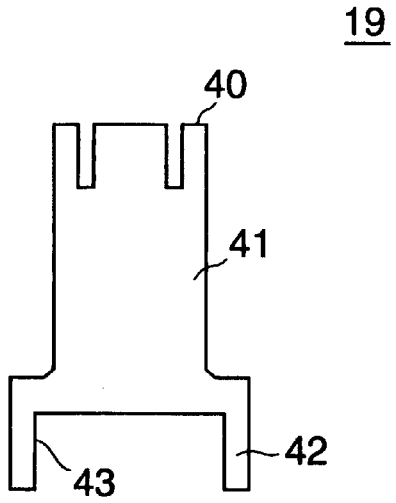
FIG. 11 shows a plan view of a hook suspension to be attached on the voice coil that is a major component of the electroacoustic transducer shown in FIG. 7.

Illustrated in FIG. 11 (a plan view) is each of two hook suspensions 19 to be attached to the voice coil 5 on both sides, as shown in the sectional view (b) and the side view (c) in FIG. 7, for protecting the voice coil 5 against lateral vibration which could occur in a low frequency range.

Each hook suspension 19 has an upper attachment section 40, a lower attachment section 42 having a space 43, and a middle joint section 41 formed between the upper and lower attachment sections 40 and 42.

Figure 12:
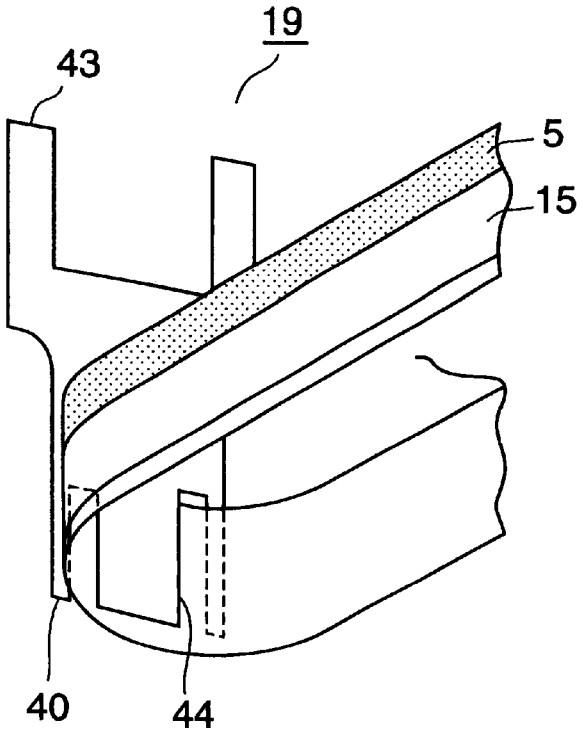
FIG. 12 shows an enlarged view illustrating the hook suspension attached on the voice coil, viewed from the voice-coil side.
Figure 13:
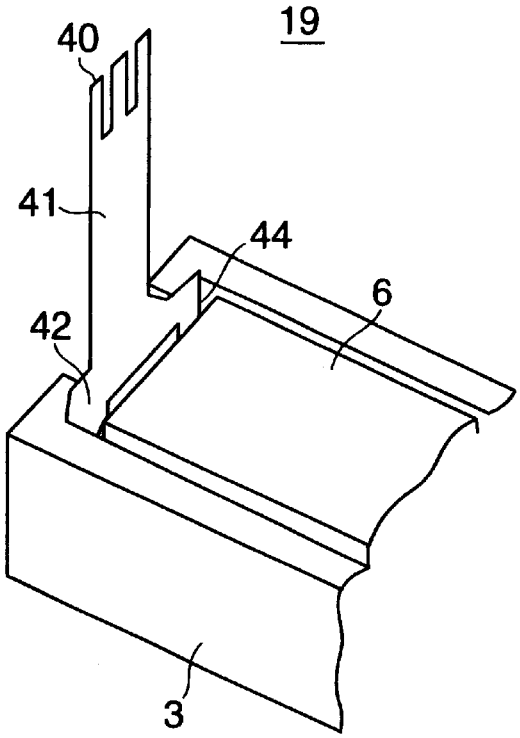
FIG. 13 shows another enlarged view illustrating the attached hook suspension, viewed from the frame side.

As illustrated in FIG. 12 (an enlarged view), the hook suspension 19 is installed such that the voice coil 5 is inserted into two slots provided at the upper attachment section 40 and fixed with an adhesive 44. The lower attachment section 42 of the hook suspension 19 is fixed inside the frame 3 with the adhesive 44, as illustrated in FIG. 13 (an enlarged view).

Disclosed next is an operation of the electroacoustic transducer 10 having the structure described above.

A magnetic field is generated around the voice-coil bobbin 4 by the magnet 7 to cause a drive current flowing the voice coil 5 for generating an electromagnetic force. A main vibrating portion la shown in the sectional view (b) of FIG. 7 is vibrated by the electromagnetic force, and thus the diaphragm 1 is vibrated.

The lower part 9*a* of the groove 9 in the diaphragm 1 has a high surface accuracy and a relatively large contact area with the upper part 4*a* of the bobbin 4, as illustrated in FIG. 10, for accurate transmission of vibration.

The convex portions 11*a* have an almost semicircular shape curved outwards in the direction of sound emission. The concave portions 12*a* also have an almost semicircular shape but curved inwards. They are provided alternately in the longitudinal direction, as illustrated in the sectional view (b) of FIG. 7. This alternative alignment of convex and concave portions complementarily cancels vibration which may otherwise occur at these portions.

Figure 14:
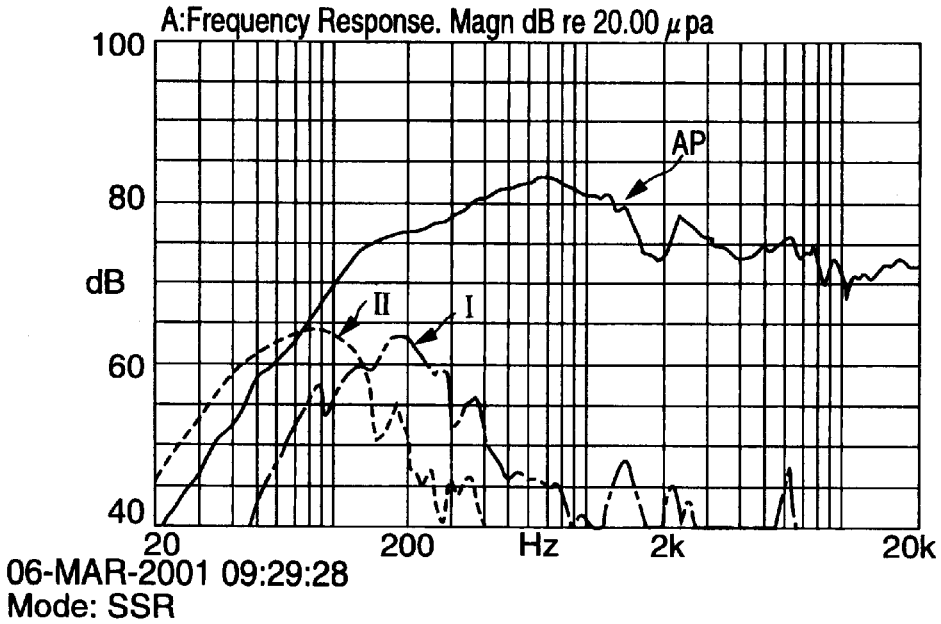
FIG. 14 shows a graph indicating the frequency characteristics of the electroacoustic transducer shown in FIG. 7 according to the present invention.

Comparison is made between the electroacoustic transducer 10 having the hook suspensions 19 according to the present invention and the electroacoustic transducer 20 with no such hook suspensions with reference to FIGS. 4 and 14.

As already discussed, the electroacoustic transducer 20 suffers the secondary and tertiary harmonic distortions I and II over the frequency range from 20 to 200 Hz, due to lateral vibration, as shown in FIG. 4.

On the contrary, according to the present invention, such harmonic distortions are suppressed by 6 to 15 dB, as shown in FIG. 14, thanks to the hook suspension 19. The acoustic-pressure frequency characteristics for the electroacoustic transducer 10 is also shown in FIG. 14.

In further comparisons, the electroacoustic transducer 10 having 0.075 mm-thick hook suspensions 19 is superior to the counterpart 20 shown in FIG. 1 against increase in input and for low-frequency range distortion characteristics.

In detail, the electroacoustic transducer 20 with no hook suspensions generated abnormal sounds to 3.3V-input at around the least resonant frequency, and suffered the secondary harmonic distortions at −2 dB at frequency below the least resonant frequency.

On the contrary, the electroacoustic transducer 10 having 0.075 mm-thick hook suspensions 19 did not generate any abnormal sounds up to 8V-input, while suffered the secondary harmonic distortions at −20 dB at frequency below the least resonant frequency.

Regarding change in the least resonant frequency, the electroacoustic transducer 20 with no hook suspensions exhibited 150 Hz for the least resonant frequency.

Contrary to this, the electroacoustic transducer 10 having the hook suspensions 19 with thickness of 0.05 mm, 0.075 mm and 0.125 mm exhibited 148 Hz, 152 Hz and 234 HZ, respectively, for the least resonant frequency. It is evident that the electroacoustic transducer having 0.075 mm-thick hook suspensions 19 is most recommendable.

Figure 15:
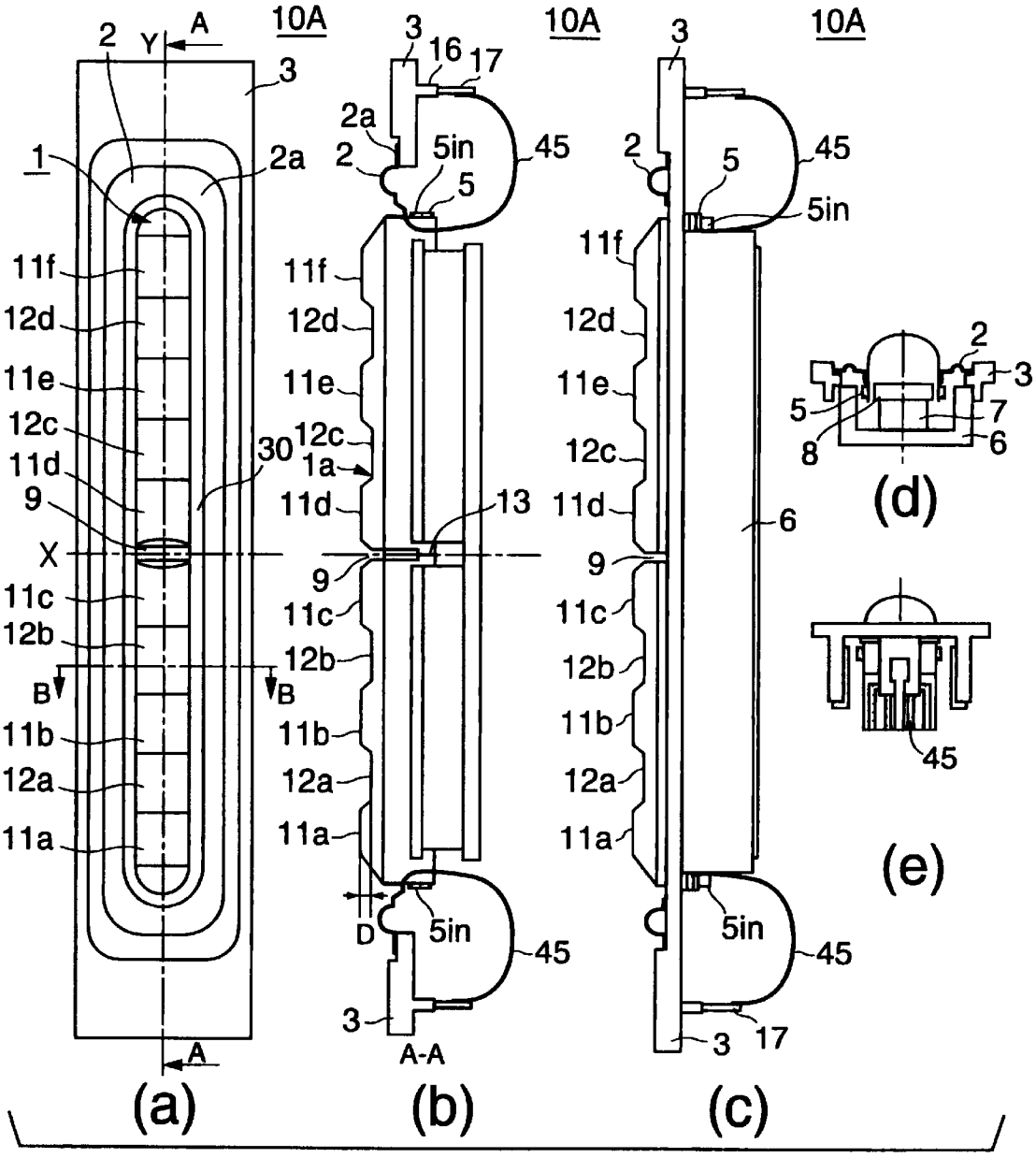
FIG. 15 shows an electroacoustic transducer as another preferred embodiment according to the present invention, with a plan view (a), a sectional view (b) taken on line A—A in the plan view (a), a side view (c) looked from direction X in the plan view (a), a sectional view (d) taken on line B—B in the plan view (a), and a side view (e) looked from direction Y in the plan view (a)

Shown in FIG. 15 is an electroacoustic transducer 10A as another preferred embodiment according to the present invention. Elements in this embodiment shown in FIG. 15 that are the same as or analogous to the elements in the former embodiment shown in FIG. 7 are referenced by the same numbers and will not be explained.

Figure 16:
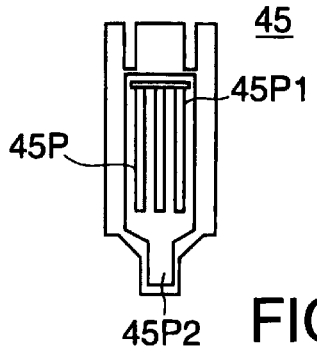
FIG. 16 is a modification to the hook suspension, used for the electroacoustic transducer shown in FIG. 15.

Moreover, shown in FIG. 16 is a modification to each hook suspension 19. A hook suspension 45 is made of a flexible substrate of polyimide in which an iron pattern 45P lies. The iron pattern 45P has an end 45P1 and another end 45P2. The end 45P1 is connected to a terminal 5in for electrical input of the voice coil 5 whereas the end 45P2 is connected to the connection terminal 17, as shown in FIG. 15. The hook suspension 45 thus functions as a suspender and also a lead wire.

As disclosed above, the present invention restricts lateral vibration in low-frequency range for reproduction of acoustic waves with almost no distortions.

Moreover, the hook suspension made of a flexible substrate functioning as a suspender and also a lead wire allows further slender configuration and stable performance for the electroacoustic transducers according to the present invention.

What is claimed is:

1. An electroacoustic transducer comprising:

a diaphragm having an asymmetric shape, having a flat vibrating surface with major and minor axes when viewed from a direction of vibration, having continuous curvatures of concavity and convexity in a direction of the major axis, provided with a slot formed almost at the center of the vibrating surface in a direction perpendicular to the major-axis direction and a groove provided along the periphery of the vibrating surface;

a fringe connected to the groove as surrounding the groove, the fringe sustaining the diaphragm against vibration;

a voice-coil bobbin connected to the diaphragm;

a voice coil wound around the voice-coil bobbin;

a magnetic circuit for applying fluxes to the voice coil for vibration;

a frame for sustaining the fringe and the magnetic circuit; and hook suspensions provided at both ends of the voice coil in the major-axis direction to support the voice coil, each hook suspension having an end portion fixed at one of the ends of the voice coil and another end portion fixed on the frame.

2. The electroacoustic transducer according to claim 1, wherein each hook suspension is made of a flexible substrate functioning as a lead wire.

* * * * *